US007859194B2

(12) United States Patent
Walker et al.

(10) Patent No.: US 7,859,194 B2
(45) Date of Patent: Dec. 28, 2010

(54) SHORT ARC LAMP DRIVER AND APPLICATIONS

(76) Inventors: Jerry Walker, 107 C. St., Vallejo, CA (US) 94590; Arie Ravid, 39481 Gallaudet Dr., #126, Fremont, CA (US) 94538; Wei Su, 1567 Samedra St., Sunnyvale, CA (US) 94087; Ronald A. Lesea, Redwood City, CA (US); Deanna Y. Lesea, legal representative, 51 Foss Dr., Redwood City, CA (US) 94062

( * ) Notice: Subject to any disclaimer, the term of this patent is extended or adjusted under 35 U.S.C. 154(b) by 1036 days.

(21) Appl. No.: 11/590,606

(22) Filed: Oct. 30, 2006

(65) Prior Publication Data

US 2008/0211420 A1 Sep. 4, 2008

(51) Int. Cl.
*H05B 37/02* (2006.01)

(52) U.S. Cl. ..... 315/209 R

(58) Field of Classification Search ..... 315/209 R, 315/210–214, 227 A, 241 P, 241 S, 244
See application file for complete search history.

(56) References Cited

U.S. PATENT DOCUMENTS

| | | | | |
|---|---|---|---|---|
| 3,792,309 | A | 2/1974 | McDonald | |
| 3,914,648 | A * | 10/1975 | Friedman et al. | 315/241 P |
| 4,275,335 | A | 6/1981 | Ishida | |
| 4,392,088 | A | 7/1983 | Hartai | |
| 4,626,093 | A * | 12/1986 | Matsui et al. | 396/109 |
| 4,742,277 | A * | 5/1988 | Shibuya et al. | 315/176 |
| 6,718,135 | B2 | 4/2004 | Kawasaki | |

* cited by examiner

*Primary Examiner*—Douglas W Owens
*Assistant Examiner*—Minh D A
(74) *Attorney, Agent, or Firm*—Charles E. Krueger

(57) ABSTRACT

A short arc lamp driving circuit includes a trigger boosting circuit, a flash current control circuit, and a closed loop exposure control and calibration circuits that, when combined, can produce short pulses of light with short time separation, quasi-continuous illumination light, and meanwhile, an extremely large dynamic range of delivered and/or calibrated light power or energy.

4 Claims, 5 Drawing Sheets

SHORT ARC LAMP DRIVER AND APPLICATIONS

BACKGROUND OF THE INVENTION

Short arc lamps, especially Xenon lamps, have been used in many applications, including camera strobes, analytical instrumentation, surgical illumination, theatrical lighting, and laser and machine vision. In spite of the availability of other more convenient and low cost light sources such as LEDs (light emitting diodes), Xenon lamps are still currently used in some niche areas because they have certain unique properties that other light sources cannot provide. These include high brightness, high power, high UV (ultra violet) light content, a wide continuous spectral distribution with excellent color balance and spectral flatness in the visible region, long life and stable spectrum over the life of the lamp.

Xenon lamps have two operation modes, namely DC and pulsed mode. The DC operation mode generally has a better arc stability and substantially longer lamp life than the pulsed mode. However, this mode of operation is not ideal for photography which only needs a short flash of illumination light while a photo is being taken. As for the pulsed mode of operation, the combination of wide spectrum and color balance with the ability to produce short pulses of high brightness light has made Xenon lamps particularly suitable for biological photography, enabling excellent color projection and high-quality flesh tones.

In this respect, short-arc flash lamps with an arc spacing of typically 1-3 mm are especially unique because they can provide pulses of high intensity light and brightness that other light sources cannot match. The high brightness and intensity is particularly desirable for superior camera performance. In addition, a short-arc flash lamp can also solve the problems related to motion of a living biological sample, such as a human eye, and hence eliminate blurring of the obtained image. Furthermore, the wide spectral distribution of Xenon flash lamps also makes them ideal for applications requiring light in specific spectral regions, such as red-free images and Fluorescein Angiography. The required spectral region is obtained by placing different types of optical band pass filters in the illumination and/or detection light path.

In its simplest form, a Xenon flash lamp is composed of a sealed glass tube with an electrode at each end and is filled with pressurized Xenon gas. A typical electronic flash circuit consists of four parts: (1) power supply, (2) energy storage capacitor, (3) trigger circuit, and (4) flashtube. FIG. 1 shows a typical Xenon flash lamp discharge circuit with a trigger circuit. The energy storage capacitor C 101 connected across the flashtube 102 is charged from a high voltage power supply 103 through a charging resistor R1 104. The capacitor 101 is often of large electrolytic type designed specifically for the rapid discharge needs of photoflash applications. The flashtube 102 remains non-conductive even when the capacitor 101 is fully charged.

In most cases a separate small capacitor Ct 105 can be charged from the trigger power supply 106 through a charging resistor R2 107. To generate a trigger pulse, the trigger source 109 is activated, the charge on the trigger capacitor 105 is dumped into the primary winding of a pulse trigger transformer 108 whose secondary is connected to a wire, strip, or a metal reflector in close proximity to the flashtube 102. The pulse generated by this trigger is enough to ionize the Xenon gas inside the flashtube 102 so that the Xenon gas suddenly becomes a low resistance and the energy storage capacitor 101 discharges through the flashtube 102, resulting in a short duration brilliant white light. Typical flash duration and intensity depends on the capacitance and the charge voltage of the storage capacitor 101. However, the cycle time is typically relatively much longer, of the order of a second, because of the time required to fully charge the energy storage capacitor.

DETAILED DESCRIPTION OF THE EMBODIMENTS OVERVIEW

Various embodiments of the invention are described for triggering, driving and controlling a short arc lamp that can produce short pulses of light with short time separation and also quasi-continuous illumination light, as well as an extremely large dynamic range of delivered light in terms of energy or averaged power that can be precisely controlled. More specifically, several embodiments of electronic circuits and methods are described that can enable a short arc lamp to achieve multiple functions desired for fast stereo photography as well as quasi-continuous illumination of a sample.

Firstly, the circuit can trigger the initiation of the discharge in a Xenon lamp in a more desirable way, substantially reducing the wandering of the discharge arc and hence stabilizing the discharge; secondly, the circuit can also enable fast recharging of the capacitors for both the main Xenon flash circuit and also the triggering circuit; thirdly, the circuit can deliver short pulses of large current at a relatively low voltage, controlling the current through the Xenon lamp in terms of peak and average current amplitude and also duration; and fourthly, the circuit can deliver a rapidly pulsed current to enable the Xenon lamp to operate in the quasi-continuous mode so that the illumination from the lamp appears continuous to an observer. Additionally, the circuit can detect the energy and instantaneous output power from the Xenon lamp and hence calibrate as well as precisely control the energy and/or the average power such that the amount of light delivered to the sample is always kept within the safety limit, and meanwhile is substantially optimized for producing a properly exposed image or live display of the sample.

Various embodiments include features useful for driving a short arc Xenon lamp for a live display and also high speed digital stereo photography or imaging of a living biological sample such as the human eye. Other features and advantages will be apparent in view of the following description and appended drawings.

DESCRIPTION

Reference will now be made in detail to various embodiments of the invention. Examples of these embodiments are illustrated in the accompanying drawings. While the invention will be described in conjunction with these embodiments, it will be understood that it is not intended to limit the invention to any embodiment. On the contrary, it is intended to cover alternatives, modifications, and equivalents as may be included within the spirit and scope of the invention as defined by the appended claims. In the following description, numerous specific details are set forth in order to provide a thorough understanding of the various embodiments. However, the present invention may be practiced without some or all of these specific details. In other instances, well known process operations have not been described in detail in order not to unnecessarily obscure the present invention.

Figure 1:
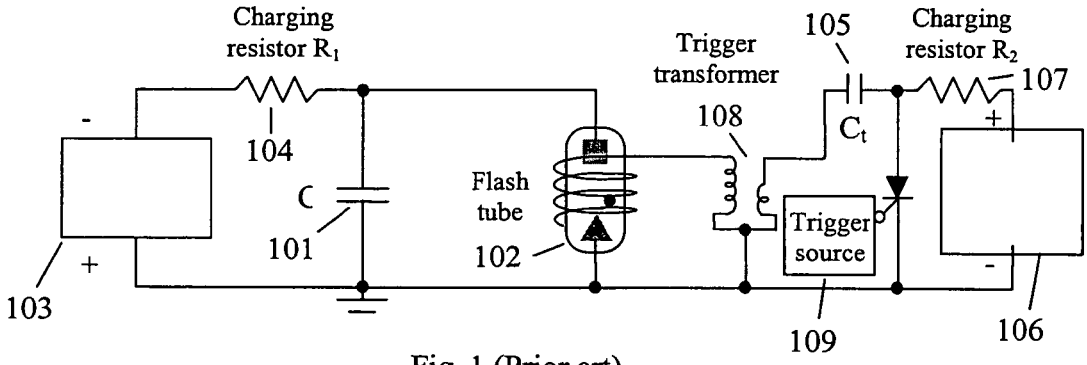
Fig. 1 (Prior art)
FIG. 1 shows a typical Xenon flash lamp discharge circuit with a trigger.
Figure 2:
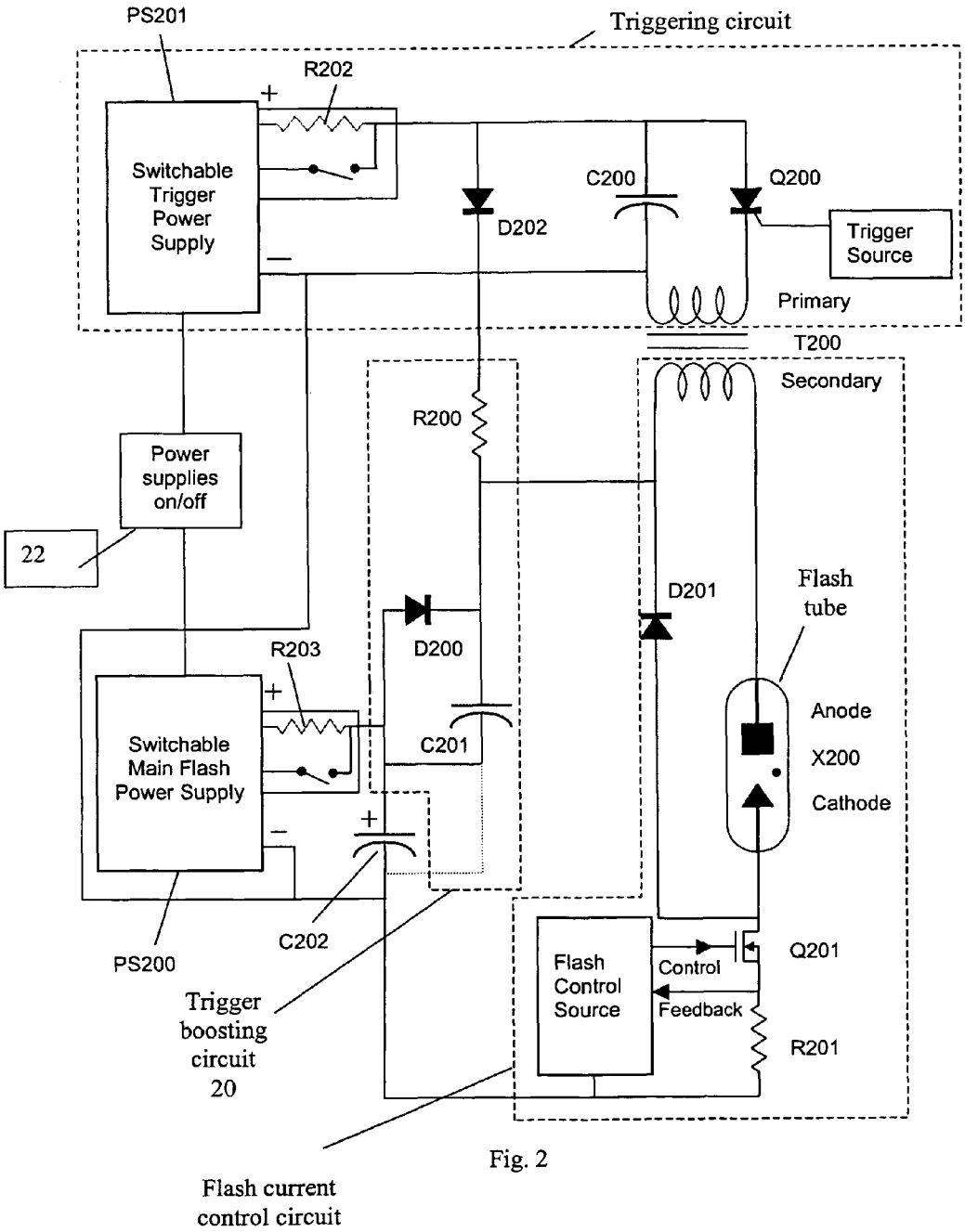
FIG. 2 shows a diagram of an embodiment of a short arc lamp driving circuit.

FIG. 2 shows an exemplary embodiment of a short arc lamp driving circuit. This embodiment is configured to drive a Xenon lamp and a main flash power supply PS200, an energy storage capacitor C202, a trigger circuit C200, Q200 and T200, a flashtube X200, and a number of additional components that enable the realization of several desired functions together with a number of unique advantages. These include the switchability of the power supplies for the main power supply and the trigger power supply, an ignition boosting circuit and a flash current control circuit, etc.

Basic Xenon Flash Circuit Operation

As shown in FIG. 2, a main power supply PS200 charges a bulk energy storage capacitor C202. In this embodiment, C202 stores substantially more charge than is used in flashing the Xenon lamp X200 for a single time. In fact, C202 may hold enough charge for tens or hundreds of flashes.

The lamp operating voltage from PS200 and C202 is connected through diode D200 and the secondary of a pulse transformer T200 to the anode of the Xenon lamp X200. The circuit continues through current control element Q201 and sensing resistor R201, and returns to the bulk storage capacitor C202 and the main power supply PS200. The function of components C201, D201, D202, Q201, and R201 is described below.

A series-mode triggering circuit is formed by trigger power supply PS201, trigger storage capacitor C200, thyristor switch Q200, and the primary of pulse transformer T200. A trigger signal can be applied to the thyristor switch Q200. Thyristor Q200 will discharge capacitor C200 very rapidly (typically in much less than one microsecond) through the primary of T200, causing a high voltage pulse to appear at the secondary of T200. The high voltage pulse will ionize the Xenon gas in the lamp X200 between its anode and cathode, forming a low-impedance path. Once the gas has an ionized path, charge flows from storage capacitor C202 through the lamp X200.

A current controlling element Q201 is inserted in the discharge path and is switched on or off to terminate the current flow in X200 before capacitor C202 has exhausted its charge. The raised impedance of Q201 reduces current flow so that current cannot maintain the ionization of gas within lamp X200 and the lamp X200 returns to its insulating state before capacitor C202 is exhausted. A typical current controlling element can be an Insulated Gate Bipolar Transistor (IGBT), or a Silicon Controlled Rectifier (SCR).

Booster for Arc Stability

A characteristic of a Xenon short arc lamp is that the exact position of the arc is not well defined for short flashes (flash duration of less than one or two milliseconds). In a system with light-gathering optics, this wander in the arc position causes difficulty in focusing the light on a specific desired area such as the end of an optical fiber bundle.

In the presently described embodiment, a trigger boosting circuit 20 is utilized to stabilize the arc position. Referring again to FIG. 2, the trigger power supply PS201 is coupled through a coupling resistor R200 and a diode D202 to a trigger boost capacitor C201 that can be connected either to the top positive side of the energy storage capacitor C202 or to the bottom negative side of the energy storage capacitor C202. Boost diode D200 isolates the trigger power supply high voltage (typically 600 to 1000 Volts) from the bulk power supply PS200, which is at a much lower voltage (typically 100 to 200 Volts). Diode D202 prevents the trigger pulse from discharging the boost capacitor C201 into the trigger circuit, preserving its energy to boost ignition in the Xenon lamp. The Xenon lamp can withstand the higher trigger voltage across its terminals without breaking down, but once the trigger spark is initiated in the lamp, the higher voltage stored on the trigger boost capacitor C201 rapidly establishes a strongly ionized path and provides for more reliable lamp startup and for less wander or uncertainty in the exact path of the established arc.

The use of the trigger supply for this boost function eliminates the need for a third power supply, improves efficiency, and reduces the size of the circuit, thus saving expense. Application of a boost voltage in a pulsed Xenon lamp stabilizes the arc position, giving a benefit in gathering Xenon light in highly-focused optics.

The above described embodiment and other embodiments of the boost trigger circuit can be utilized as a boost circuit for triggering a non-DC based arc lamp. For example, other embodiments utilize a third power supply and additional components. Additionally, the various embodiments can be utilized to discharge lamps using any other mix of gas and halides and is not restricted to Xenon alone.

Power Supply Control for Rapid Restart

The trigger power supply PS201 and the Main Power Supply PS200 usually have a certain "internal" impedance, represented by resistors R202 and R203 respectively. A problem associated with these "internal" impedances represented by R202 and R203 is that they will limit the response time of the circuits, as the capacitors C200 and C202 must charge through these impedances.

For some particular applications, such as stereo digital imaging of the fundus of a living human eye, two short pulses of flash light need to be generated within a short time, on the order of a few tens of milliseconds (say 40 ms), in order to ensure that two stereo images of the same region of interest are captured before the eye has a chance to move. The embodiment depicted in FIG. 2 provides for rapid recharging to facilitate the rapid generation of multiple short pulses.

In one embodiment of the invention, the two power supplies PS200 and PS201 are instantly switchable from "off" to "on and supplying current" state. As a result, each can be individually disconnected, i.e. completely isolated, from its circuit, once gas discharge in the arc lamp is ignited. Furthermore, the "internal" impedances represented by R202 and R203 are also eliminated so that the charging time is substantially shortened, which means quick recharging of the corresponding capacitor(s).

In one embodiment, the trigger circuit power supply PS201 is controlled by an external ON/OFF circuit 250 and is turned off at the beginning of a flash event. This prevents power supply current from continuing to flow into the low impedance of the triggered thyristor Q200 and damaging the thyristor or the power supply, and prevents the waste of energy from the supply into a trigger circuit that has completed its function. Once the flash has terminated and the impedance of thyristor Q200 has recovered, the power supply PS201 is turned on to charge the corresponding capacitor(s) for the next flash with the "internal" impedance represented by R202 greatly reduced or eliminated. As a result, the charging time for capacitor C200 is substantially shortened.

Similarly, as an option for the main flash power supply PS200, the external ON/OFF circuit 22 can be used to turn off the power supply at the beginning of a flash; once the flash has terminated, the power supply PS200 can be turned on for the next round of capacitor charging with the "internal" impedance represented by R203 eliminated to increase the charging speed. This switched mode for the main power supply may not be needed because of the novel current control circuit described below. However, this ability to turn off the power supply very quickly enables safety circuit that can monitor the Xenon flash power and control the main power supply to prevent over-exposure of the samples being examined.

An advantage of this technique is to allow rapid recharging (typically less than 10 milliseconds) of the trigger circuit in preparation for another flash event, using only conventional and low-cost power supply techniques. The elimination of discrete energy-wasting elements such as the "internal" impedances R202 and R203 reduces heat generated in the power supplies and improves reliability as well as energy efficiency.

An important application of these features is stereo digital imaging of the fundus of a living human eye. A requirement of this application is the live display and monitoring of a sample, which is often desired in order to show the region of interest before the image is taken, in a similar way as for a digital camera. This generally requires a lower intensity continuous or quasi-continuous illumination of the sample.

The rapid flash cycles facilitated by the currently described embodiment allow the use of the Xenon lamp in a quasi-continuous mode (for example, at more than 60 flashes per second), making the light source give the appearance of continuous illumination to an observer so that the sample can be displayed and monitored.

Active Control of Lamp Current

Figure 3:
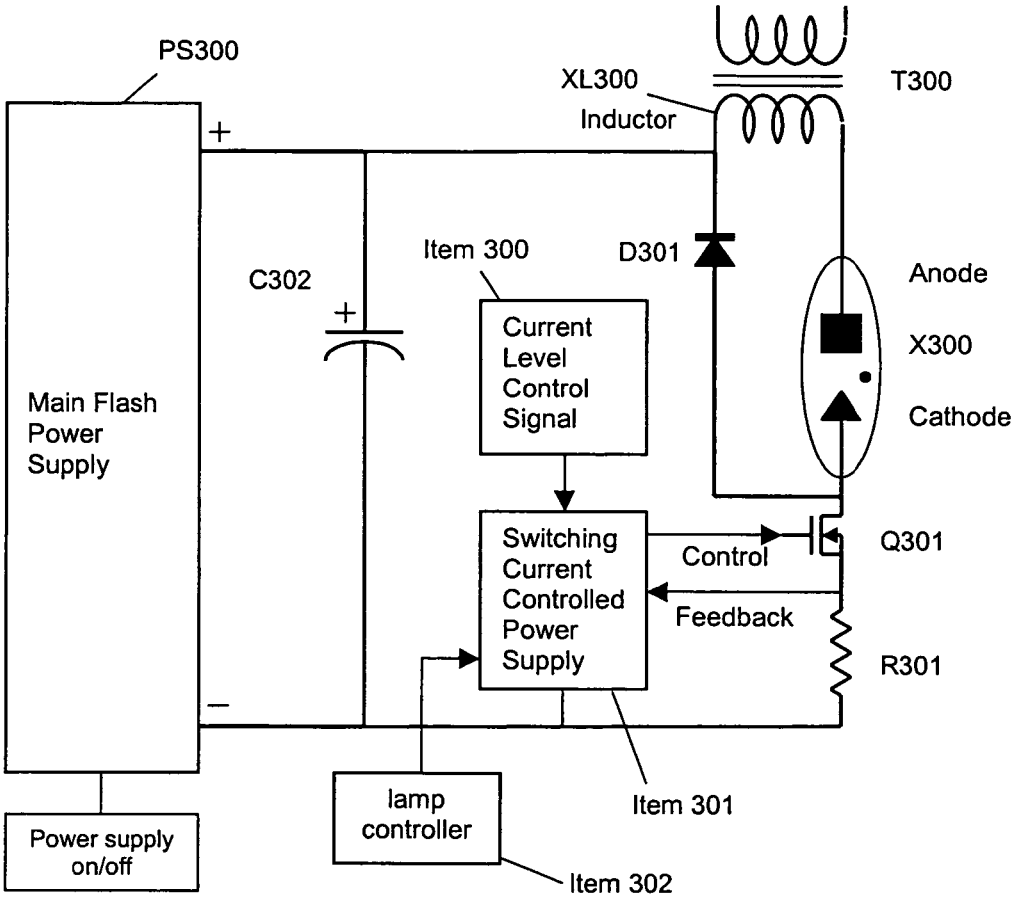
FIG. 3 shows an embodiment of an active flash current control circuit of the short arc lamp driving circuit shown in FIG. 2.

FIG. 3 shows an embodiment of the active flash current control circuit of the Xenon flash circuit shown in FIG. 2. In the following it is assumed that the Xenon lamp has already been ignited and is conducting current. Power supply PS300 and bulk storage capacitor C302 provide the main power for the Xenon flash. Observe the loop formed by energy storage capacitor C302, the secondary XL300 of pulse transformer T300, flash tube X300, current control element Q301, and feedback resistor R301. This is the main current loop for a buck-type switching power supply.

The gate of current control element Q301 is controlled by a current-mode switching current controlled power supply (Item 301), using a common control integrated circuit such as the UCC3843 from Texas Instruments. A lamp controller 302 can turn this switching power supply on and off, and another current level control signal generator 300 can set a value which controls the current level for the switching power supply. The control output from this switching power supply ("Control" in FIG. 3) turns the switching element Q301 on and off. The feedback ("Feedback" in FIG. 3) obtained from the feedback resistor brings a sample of the actual Xenon lamp current to the switching current controlled power supply, where it is compared to the desired current set by the current level control signal Item 300. When the magnitude of feedback signal exceeds the magnitude of the current level signal the switching current controlled power supply turns off the current control element. As described more fully below, the secondary winding of the transformer dampens the oscillations of the current value so that the average current value is set by the magnitude of the current level control signal.

Further, when the lamp controller turns off the switching current controlled power supply the current control element is also turned off. Thus, by controlling the intervals between turning off and turning on the switching current controlled power supply the average value of the current can be precisely controlled over a wide dynamic range.

The switching current controlled power supply 301 acts to regulate the current flowing in the circuit, including the current flowing through the Xenon lamp X300. Note that the feedback sensing element, here exemplified by a resistor, may be any other means of sensing current including a Hall Effect sensor, Giant MagnetoResistor (GMR), or a current transformer.

Although in the above discussion the active flash current control circuit is positioned at the cathode side of the Xenon lamp, in other embodiments a similar current control circuit can be positioned at the anode side of the Xenon lamp.

In this embodiment, the pulse transformer T300 is used for dual purposes. It was initially used as a trigger transformer to generate a high-voltage spark to ionize the Xenon gas. In this part of the circuit, the secondary XL300 of the same transformer T300 now acts as an energy-storage inductor, to limit the rate of change of current in the Xenon lamp. The current in the Xenon lamp must not be allowed to change more rapidly than the switching controller can react. Using T300 in this dual fashion eliminates using a separate inductor, and eliminates the problems associated with getting the high-voltage ignition spark past a second inductor.

Figure 4:
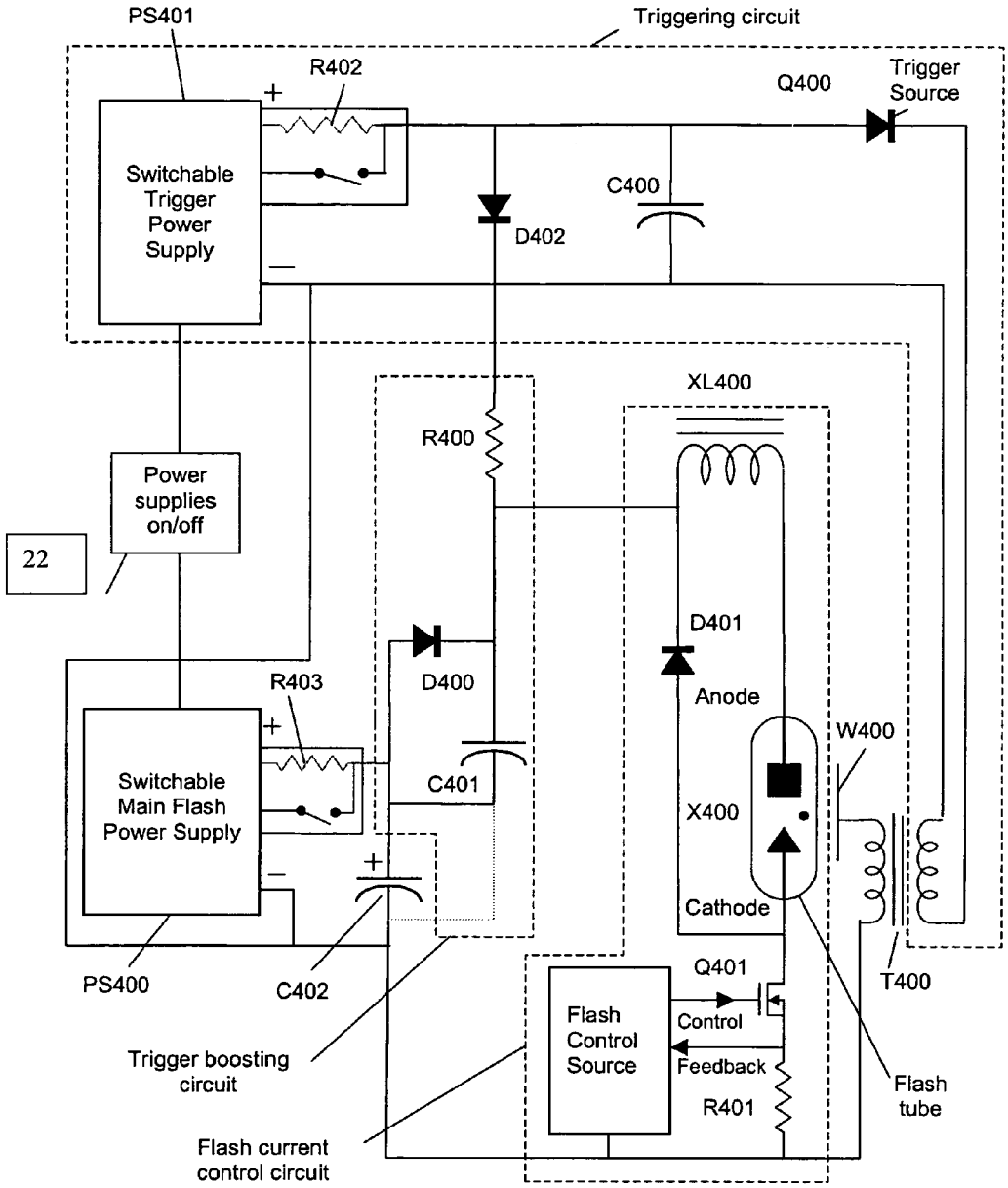
FIG. 4 shows an embodiment of the exposure control and calibration diagram of the short arc lamp driving circuit.

In an alternate embodiment a separate inductor is used to limit the rate of change of current in the Xenon lamp. In some applications, it is advantageous to use independent external triggering and independent induction. In this embodiment, depicted in FIG. 4, there is no longer the requirement for the dual functioning of the transformer. All the other benefits, including the generation of short pulses of light with short time separation, quasi-continuous illumination light, and an extremely large dynamic range of delivered and/or calibrated light power or energy, can be retained even with splitting the trigger function from the inductor function, and the value and quality of the series inductor can now be optimized for value, cost and quality independently of the size and power of the trigger transformer. For example, a low loss inductor XL400 can be better selected for the pure purpose of limiting the rate of current change. On the other hand, the triggering of the Xenon lamp can be achieved using an external wire W400 wrapped around the Xenon lamp X400. Additionally, specialized lamps with arc guiding electronics can also be used with the external trigger circuit Coming back to FIG. 3, with T300 used in dual fashion, the diode D301 functions as the "freewheeling" diode commonly required in a switching power supply. When the switching element Q301 is turned on, current increases in the secondary inductor XL300 of the pulse transformer T300 according to $V=L\,di/dt$, or $V/L=di/dt$, where V is the voltage across the inductor (in Volts), L is the inductance (in Henries), and di/dt is the rate of current change per unit time (in Amperes per Second).

When the current control element Q301 is turned off, the current in the inductor must keep flowing. The present circuit allows the inductor current to continue flowing through the Xenon lamp and back to the inductor through the "freewheeling" diode D301. Closing the current loop around the Xenon lamp with D301 provides the benefit of maintaining an almost constant current through the lamp to reduce flicker and improve power efficiency.

In this embodiment, the switching current controlled power supply 301 is turned on slightly before or simultaneously with the ignition of the Xenon lamp, in order to allow boost current and main power supply current to flow through the lamp. Unlike a conventional Xenon lamp circuit, the lamp current is not merely limited by circuit impedances but is actively controlled at a relatively low level. For example, a conventional Xenon lamp circuit to provide a 50 Joule flash will allow a peak current of 2000 Amperes or more through the Xenon lamp, for a duration between 100 microseconds and 2 milliseconds. This sudden shock of high current is a leading cause of aging in Xenon lamps and in the associated bulk storage ("flash") capacitors. In contrast, in the presently described embodiment, the circuit controls current to only a few hundred Amperes for a duration that may extend to milliseconds or tens of milliseconds. The initial rate of rise of the main current is slowed significantly by the inductance XL300 of T300 and by the active switching, greatly reducing the shock to the Xenon lamp. The rate of rise of the current is actively and intelligently controlled, not just limited by the specific components chosen. As a result, the lamp lifetime is greatly improved by this gentle treatment.

Thus, the active current control circuit for the Xenon lamp brings a number of advantages. Firstly, the novel use of the Xenon lamp X300 within the control loop of a conventional switching current controlled power supply allows precise control of Xenon light intensity by active control of current. Secondly, the Xenon lamp intensity is controllable over a very large range, more than 12:1. This is compared with approximately 6:1 variation for the best commercially available Xenon sources (e.g., PerkinElmer LS1130 FlashPac). Thirdly, controlling the peak current in the Xenon lamp also improves lamp lifetime and reliability. For example, the circuit shown in FIG. 3 can operate at 1/10 the peak current of a conventional Xenon flash circuit. Furthermore, combining the pulse transformer T300 with the inductance required for a switching power supply eliminates an expensive, bulky component. Fourthly, the inductance in the pulse transformer T300 controls the current rise time in the Xenon lamp X300, which greatly reduces stress on the Xenon lamp and increases its lifetime. Additionally, using a fast control element such as a MOSFET transistor instead of the current art IGBT (Insulated Gate Bipolar Transistor) increases the speed of the lamp regulating circuit, increasing its efficiency and improving the evenness of the delivered light.

Active Control Of Flash Duration

In one embodiment, when the switching current controlled power supply Item 301 is turned on and current is flowing, the duration of the current flow is completely under the control of the external lamp controller 302 and can be shortened or extended as needed to deliver the desired amount of light to an application. In this embodiment, the duration control can be provided by a microcontroller, or a microcomputer, or other circuits. Control can also be provided by closed loop operation engaging the measurement of a fraction of light delivered to or returned from a desired target, so that, for example, the light reflected from a photographic subject can be controlled actively to provide correct illumination and/or exposure at a camera. Further, the greatly extended flash duration allows use of convenient remote-control channels for controlling the exact flash duration. Compared to the less well-controlled waveforms of current through the lamp in conventional Xenon flash circuits and the short duration of their flashes, the presently described embodiments provide a more precise control of lamp energy delivered through control of duration at a constant current. This provides greatly improved flexibility and accuracy in controlling actual optical/electrical energy in the pulse, even in the case of open loop operation to control light intensity and duration. For comparison, a conventional Xenon flash duration is from less than 100 microseconds to perhaps one or two milliseconds. In the embodiment described here, the duration can be controlled from less than 50 microseconds to well over 10 milliseconds.

Figure 5A:
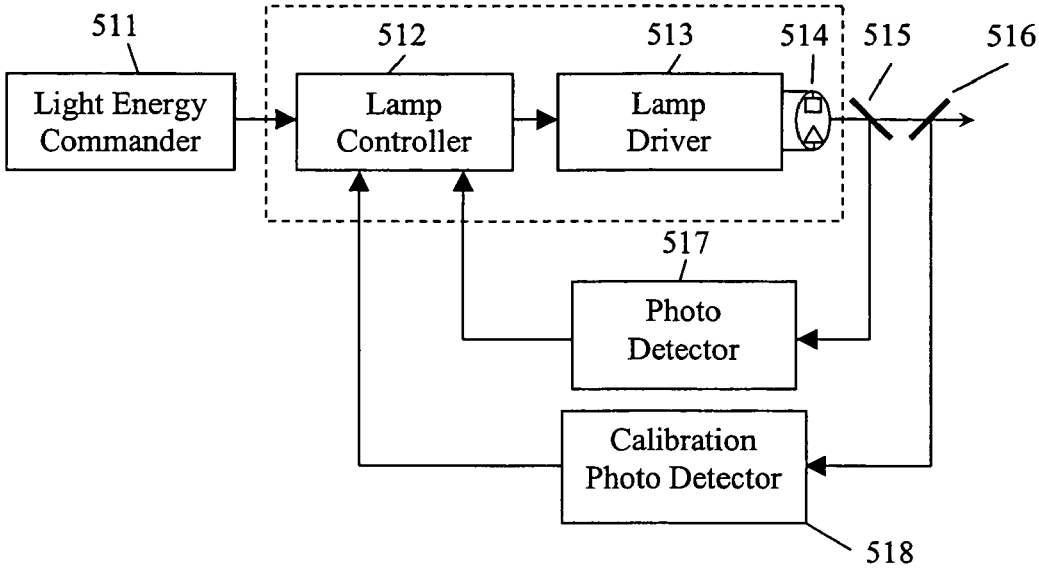
FIG. 5*a* depicts an embodiment of a closed loop control system.
Figure 5B:
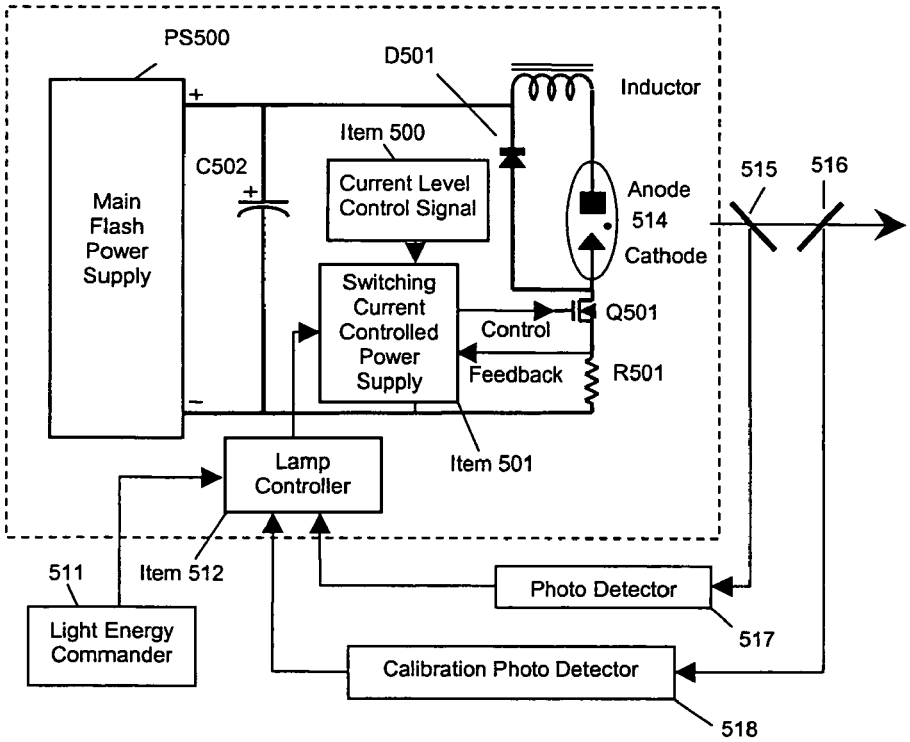
FIG. 5*b* depicts an embodiment of a closed loop control circuit.

FIG. 5*a* and FIG. 5*b* present alternative closed loop operation embodiments of the flash control circuit, where the light duration control can be performed in a closed loop manner by measuring the total integrated optical energy delivered and shutting off the light source when pre-set light energy has been generated. A unique feature of this embodiment of the flash control circuit is that the light duration can be readily and economically controlled over more than a 100:1 range, allowing great flexibility and precision in the total amount of light energy delivered. Another unique feature is the ability to extend the flash to in excess of 10 milliseconds, allowing for an efficient circuit implementation of feedback control of the flash duration via a relatively slow serial connection.

In the embodiment depicted in FIG. 5*a*, the Light Energy Commander 511, which could be a minicomputer or microcontroller based, sends a flash light energy command to the Lamp Controller 512 via a serial communication line.

[44] The Xenon Lamp 514 generates a light beam that reaches the sample for the purpose of viewing and/or imaging. A fixed small fraction of the light beam is fed into the Photo Detector 517 and is converted there into electrical signals that signify both instantaneous light (intensity) and integrated (over time) light (energy). These signals are fed back into the Lamp Controller 512, which compares the fed-back light power or energy to the original command from the Light Energy Commander 511 and terminates the Xenon current and thus, the light beamlighting via the Lamp Driver 513. The feedback signal is used to maintain the level of light energy output from the lamp to its nominal level either for each individual flash or set of flashes.

In normal operation (as opposed to calibration), the accuracy of the light energy delivered to the sample depends on many factors, such as aging of the Xenon Lamp 514, the Lamp Driver 513 and parts of the optical system (like fibers) as well as accuracy of the Photo Detector 517. To maintain accurate light level at the sample, periodic calibration is required. The calibration can be performed by installing a fractional Reflector 516, with fixed reflectivity, in the light path. The reflector directs a small fraction of a calibration sample returned light beam into a Calibration Photo Detector 518, which converts the detected light into electrical signals that signify both instantaneous light and integrated light. The signals from the Photo Detector 517 and the Calibration Photo Detector 518 are compared in the Lamp Controller 512 and a calibration table is constructed. The calibration table is used until such time as the next calibration is performed.

FIG. 5*b* depicts the system of FIG. 5*a* implemented utilizing the circuits described in the embodiment depicted in FIG. 3.

As an additional advantage, the closed loop configuration of FIGS. 5*a* and 5*b* can be further used for safety control purposes. When the detected light level intensity signal coming from the Photo detector or the length of is found to exceed a safety limit level as determined from the last calibration, the Lamp Controller can turn the lamp off via the Lamp Drived and simultaneously send out a request for a new calibration or maintenance.

The electrical signals mentioned above may be presented in many formats. They may be controlled on a common communications bus (e.g., RS-232 serial, RS-485 serial, CANBUS, and others) and located remotely from the end-user (on the floor, in the next room, etc.). The desired total illumination from the Xenon flash may be measured at a remote location (a doctor's examining chair) as well. Because of the greatly extended flash duration, there is time for the communications to reach the Xenon source and effect termination before significant "excess" illumination has been delivered. This is a unique benefit derived from the long, controlled duration of the Xenon flash.

Wide Dynamic Range of Pulse Energy

The illumination provided by the Xenon lamp can be very finely controlled over a very wide range. Conventional Xenon flash circuits have a dynamic range (weakest flash to brightest flash) of only about 16:1, controlled by a combination of changing the Xenon operating voltage and the flash duration.

Changing the operating voltage of the Xenon lamp will shift the color temperature, the infrared spectral component, and the ultraviolet spectral component of the generated light. In many applications, the color temperature and balance are critical and the system must be adjusted carefully to match the Xenon lamp characteristics. Providing wider range than the traditional 16:1 way requires expensive switching of banks of flash capacitors, which is both costly and bulky.

In one embodiment, by varying both the current level and the duration of the flash, the flash current control circuit can provide a dynamic range of light illumination energy exceeding 1000:1 without switching capacitor banks. The current level is controlled by setting the current level control signal, and duration is controlled by programming the ON/OFF cycles of the lamp controller (FIG. 3). This very wide dynamic range can be achieved by combining a wide dynamic current amplitude with a wide dynamic time duration range, allowing control of total illumination energy of more than 1000:1 range. The advantage of the present approach of wide dynamic range control over the optical energy delivered to an application is that by maintaining a relatively constant current through the Xenon lamp rather than changing the power supply voltage and therefore the lamp current density to change the intensity, the color temperature and the spectral distribution of the emitted light stays basically the same. This eliminates re-calibration of the system's color response for different Xenon power levels. It is practical with the present invention to control the peak current at accuracy of 5%, and average current at accuracy of much less than 5%, compared to current variations of 10:1 in conventional flashlamp circuits.

Dynamic Interleaving of Different Pulse Energy Levels

The presently described embodiments allow control of the flash timing, intensity and duration on a flash-by-flash basis at a frequency well over 60 pulses per second. At that frequency, the lamp will appear to be continuous to the naked eye of an observer. The illumination from the lamp can be stopped at any instant and then triggered with single or multiple pulses at different energy levels.

This type of flexibility in lamp control extends the application of lamps to various areas. For example, a subject can be illuminated with DC-like light for visual observation, and then a still image of the object can be captured instantly following a single strobe light from the same lamp source. The light pulses in DC-like mode and single triggered pulse mode can be easily synchronized with the image capturing device. As a result, the brightness of a live image is maintained constant without flickering, while the still image is captured with the right timing and minimum motion-induced blurring. Meanwhile, the brightness of live images and captured images can be adjusted independently. This approach simplifies the illumination system design by replacing two light sources and control circuits with a single circuit, while eliminating the need for matching the optical characteristic of two lamps.

The ability to dynamically adjust the light source to accommodate different light intensity requirements is a great benefit for photographing difficult-to-see subjects, such as subtle pathology within an eye. The subject, light angle, spectrum, and intensity can all be adjusted until a good image is viewed, then the identical light source (except for intensity changes) is used to capture the image.

Applications

Additional embodiments of the invention apply the circuit embodiments described above as solutions in various fields.

An embodiment of the invention utilizes features described under the heading of Boost for Arc Stability in applications utilizing a short-arc lamp in a flash mode, such as for medical samples, photographic copying, and spectral reading instruments. An embodiment of the invention utilizes features described under the headings of Power Supply Control for Rapid Restart in applications where rapid cycling is desired such as for flash-pumped lasers and industrial photographic flash units.

An embodiment of the invention utilizes features described under the headings of Active Control of Lamp Current and Active Control of Flash Duration in commercial and amateur photographic flash units, to extend the flash tube lifetime and to allow remote control of flash exposure. A good example is to incorporate these embodiments into a "slave" flash, and allow the camera to communicate to the slave when sufficient light has been received at the camera. Communication means can be by radio, light (infrared pulses, for example), on-off flashing of the camera main flash unit or wire.

An embodiment of the invention utilizes features described under the heading of Wide Dynamic Range of Pulse Energy in commercial and amateur flash photography to substantially increase the f-stop dynamic range from about four to over ten.

The same approach is also applicable to commercial use of flash lamps for processing material such as UV curing of glues by flashing a UV light source, which is often just a Xenon or other type of arc discharge lamp. The wide dynamic range that the present method provides can offer better control over the curing process, including dynamic control over a wide range without affecting the process flow time. For example, a glued joint on an assembly line can move at a constant speed (set by other factors), and the UV exposure can be controlled as necessary to cure the glue in the time allotted.

Conclusion

It is to be understood that the description of the preferred embodiments of the invention are only for purposes of illustration. Those skilled in the art may recognize other equivalent embodiments to those described herein; which equivalents are intended to be encompassed by the claims attached hereto. For example, several of the above-described embodiments are configured using short arc Xenon lamp, however the driving and controlling circuit can be used for a wide range of applications. In particular, as understood by persons having ordinary skill in the art, the lamp does not need to be restricted to a Xenon lamp and can be other lamps that operate on gas discharge, including, for example, mercury, Xenon/mercury, halide lamps. In addition, the circuit can also be used to pulse gas lasers. Accordingly, it is not intended to limit the invention except as provided by the appended claims.

What is claimed is:

1. A system comprising:

a transformer having primary and secondary windings;

a trigger power supply having first and second terminals;

a trigger circuit including the primary winding of the transformer and a trigger capacitor coupled to be charged by the trigger power supply;

a main power supply having first and second terminals;

a bulk energy storage capacitor coupled to the first and second terminals of the main power supply to be charged by the main power supply;

a boost capacitor;

a first diode coupling the first terminal of the trigger power supply to the boost capacitor in the forward conducting direction;

a second diode isolating the first terminal of the main power supply from the boost capacitor;

first and second nodes adapted to be coupled to the terminals of a gas discharge lamp, with the bulk energy storage capacitor and the boost capacitor coupled to the first node via the secondary winding of the transformer;

a current limiting element, having a control input adapted to receive an ON signal, coupling one of said nodes to a terminal of the main power supply, that conducts current when a received ON signal is asserted;

a feedback element coupled to a node to output a first current level value indicating the magnitude of current passed through the current limiting element;

a current level control unit that outputs a second current level; and a source control unit, having a first input coupled to the feedback element, a second input coupled to the current level control unit, and an output coupled to the control input, that asserts an ON signal when the first current level value is less than the second current level.

2. The system of claim 1 further where the source control unit has an ON/OFF input and further comprising:

an ON/OFF circuit, having an output coupled to the ON/OFF input of the source control unit that controllably asserts or de-asserts the ON signal to turn the source control unit ON or OFF to control the amount of light output from the lamp.

3. A gas discharge drive circuit for supplying current to drive the discharge of a gas discharge lamp comprising:

first and second terminals adapted to be coupled to a gas discharge lamp;

a current control element coupled to a first terminal having a control input for receiving an ON signal, with the current control element conducting current only when the ON signal is asserted;

a feedback element coupled to output a first current level value indicating the magnitude of current passed through the current limiting element;

a current level control unit that outputs a second current level value; and a source control unit, having a first input coupled to the feedback element, a second input coupled to the current level control unit, and an output coupled to the control input, that asserts the ON signal when the first current level value is less than the second current level.

4. A gas discharge drive circuit for supplying current to drive the discharge of a gas discharge lamp comprising:

first and second terminals adapted to be coupled to a gas discharge lamp;

a current control element, coupled to a terminal, having a control input for receiving an ON signal, with the current control element conducting current only when the ON signal is asserted;

a feedback element coupled to output a first current level value indicating the magnitude of current passed through the current limiting element;

a current level control unit that outputs a second current level;

a source control unit, having a first input coupled to the feedback element, a second input coupled to the current level control unit, and an output coupled to the control input, that asserts the ON signal when the first current level value is less than the second current level; and a controller, coupled to the source control unit, programmable to turn the source control unit ON and OFF to control the average value of current through the gas discharge lamp.

* * * * *